United States Patent [19]

Miki

[11] 4,240,178

[45] Dec. 23, 1980

[54] CURTAIN RUNNER

[75] Inventor: Kiyotsune Miki, Osaka, Japan

[73] Assignee: SM Industrial Company, Limited, Japan

[21] Appl. No.: 969,336

[22] Filed: Dec. 14, 1978

[30] Foreign Application Priority Data

Feb. 24, 1978 [JP] Japan ..... 53/23627[U]

[51] Int. Cl.[2] ..... A47H 15/00

[52] U.S. Cl. ..... 16/93 D; 160/345

[58] Field of Search ..... 16/93 D, 94 D, 95 D, 16/96 D, 87.4 R, 87.2 R, 87.6 R; 160/345, 346, 347

[56] References Cited

U.S. PATENT DOCUMENTS

| | | | |
|---|---|---|---|
| 2,848,734 | 8/1958 | Ault | 160/345X |
| 3,361,190 | 1/1968 | Snyder | 160/345 |
| 3,651,546 | 3/1972 | Hartmann | 16/93 D |

FOREIGN PATENT DOCUMENTS

| | | | |
|---|---|---|---|
| 734758 | 5/1966 | Canada | 16/87.4 R |

*Primary Examiner*—George H. Krizmanich

*Attorney, Agent, or Firm*—Larson, Taylor and Hinds

[57] ABSTRACT

A curtain runner T-shaped in a front view for use with a tubular curtain rod. The curtain runner is mountable on or removable from a groove at the bottom of the tubular rod by turning a leg of the runner in the groove through about 90 degrees.

4 Claims, 8 Drawing Figures

CURTAIN RUNNER

This invention relates to a curtain runner, and more particularly to improvements in a curtain runner T-shaped in a front view and adapted for use with a tubular curtain rod having a groove in its bottom and a pair of opposed guide rails defining the groove, such that the runner is travellable along the groove when runner portions on the opposite sides of the head of the runner are supported on the guide rails with the leg of the runner retained in the groove against rotation.

Tubular curtain rods are usually provided at their opposite ends with end caps for preventing the runners fitting in a bottom groove of the rod from dropping off the rod at the opposite ends of the groove. The runner on the curtain rod, when failing to travel smoothly during use, must be replaced by a new one. Further when a curtain is suspended from the runners mounted on the curtain rod, some runners may remain unused, in which event it is desirable to remove the remaining runners from the curtain rod since they would interfere with the travel of the curtain suspending runners. However, the end cap attached to either end of the curtain rod must be removed therefrom before the replacement or removal of any runner. The procedure for the removal and reinstallation of the end cap usually requires an implement such as a screwdriver and also necessitates considerable time and labor because the work involved must be performed at an elevated location.

Curtain runners heretofore known have another problem in that the curtain rod can not be replenished with runners except at either end of the row of runners mounted thereon. When a runner is to be installed on the rod at an intermediate position of the row, therefore, there arises the necessity of mounting the runner at one end of the row and shifting all the runners between the intermediate position and that runner toward the intermediate position. The runners to be shifted must then be individually detached from the curtain before shifting and attached to the curtain again after shifting. This is a very cumbersome procedure.

The main object of this invention is to provide a curtain runner which is mountable on or removable from a curtain rod with extreme ease as if by a single action without detaching an end cap from the end of the curtain rod and further without the necessity of detaching the curtain from the runners on the rod.

The above and other objects of this invention will become apparent from the following description.

The present invention provides a curtain runner for use with a tubular curtain rod having a pair of guide rails opposed to each other at its bottom and a groove defined by the guide rails, the runner being T-shaped in a front view and including a head having runner portions on its opposite sides and a leg extending downward from the head, the runner being travellable along the groove with the runner portions supported on the guide rails of the curtain rod and with the leg inserted in the groove against rotation. The curtain runner is characterized in that the leg has at least one aperture extending therethrough in parallel to the axis of the runner portion to impart springlike elasticity to the front and rear outer walls of the leg. The runner is therefore shiftable from its proper mounted position to a non-mounted position or from the non-mounted position to the proper mounted position by turning the leg in the groove through about 90 degrees while pressing and deforming the outer walls inward against the springlike elasticity thereof. When measured in the direction of travel of the runner, the runner head has a width approximately equal to or smaller than the width of the groove so that the runner in the non-mounted position is insertable into or withdrawable from the groove. The leg has such a width in the direction of travel of the runner that it can be inserted into or withdrawn from the groove with or without inwardly pressing the outer walls against the springlike elasticity thereof.

According to the present invention, the head and leg of the runner, when positioned with the axis of the runner portions in parallel to the groove, is insertable into or withdrawable from the groove of the curtain rod from therebelow. The runner thus inserted in the groove is easily shiftable from its proper mounted position to a non-mounted position or from the non-mounted position to the proper mounted position by turning the leg through about 90 degrees while pressing and deforming the outer walls inward against the springlike elasticity thereof.

According to this invention, therefore, the runner is properly mountable on the curtain rod by inserting the head and then the leg into the groove with the axis of the runner portions positioned in parallel to the groove and thereafter turning the runner through about 90 degrees. The runner in the proper mounted position, when turned through 90 degrees to the non-mounted position, can be readily withdrawn from the groove.

In this way, the runner is directly mountable on or demountable from any desired portion of the groove of the curtain rod from therebelow. This permits the replacement or removal of the runner on the curtain rod with extreme ease as if by a single action without resorting to a cumbersome procedure as needed for the conventional runners.

While the runner is in its proper mounted position, the leg which is held in the groove against rotation assures that the runner will retain this position with stability for smooth travel.

This invention will be described below with reference to the embodiments shown in the accompanying drawings, in which:

FIGS. 1 to 5 show a curtain runner of this invention which is T-shaped in a front view as seen in FIG. 3. The runner is usually made of synthetic resin having suitable elasticity such as polyethylene.

Figure 5:
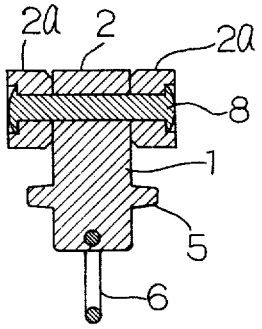
FIG. 5 is a view in section taken along the line V—V in FIG. 1.
Figure 4:
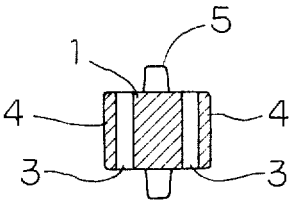
FIG. 4 is a view in section taken along the line IV—IV in FIG. 1.

The runner includes a head 2 provided with runner portions 2*a*, 2*a* on its opposite sides. The runner portions 2*a*, 2*a* may be of the roller type as illustrated or of the slider type. FIG. 5 shows a shaft 8 for rotatably supporting the runner portions 2*a*, 2*a*. The runner portions 2*a*, 2*a* and shaft 8 can be made of metal.

Figure 1:
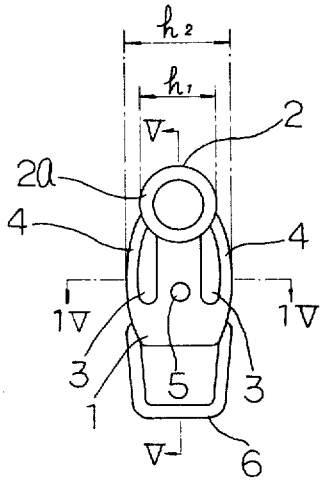
FIG. 1 is a side elevation showing an embodiment of the invention.

The head 2 including the runner portions 2*a*, 2*a* has a width $h_1$, as measured in the direction of travel of the runner (see FIG. 1), which is approximately equal to or slightly smaller than the width of a groove b formed in the bottom of a curtain rod a so that the head can be inserted into the rod a with its shaft 8 parallel to the groove b.

Figure 3:
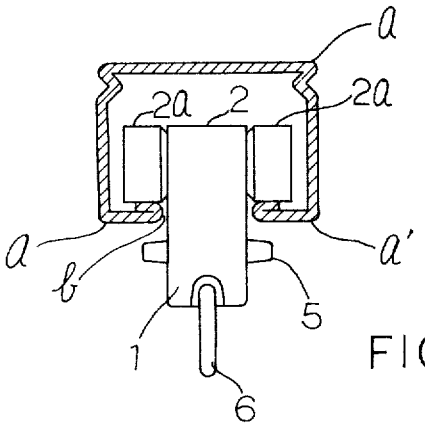
FIG. 3 is a view showing the same in its proper mounted position.

The runner includes a leg 1 extending downward from the head and having such a width $h_2$ that the runner is retainable in the groove b against rotation when in its proper mounted position shown in FIG. 3. The width $h_2$, for example, is larger than the width of the groove b, or may be approximately equal to the width of the groove b.

The leg 1 is formed with apertures 3 extending therethrough longitudinally of the shaft 8 to impart elasticity to the front and rear outer walls 4, 4 of the leg 1. Although the illustrated leg 1 has a vertically elongated aperture 3 in each of front and rear sides thereof, only one aperture may be formed to give springlike elasticity to the front and rear outer walls 4, 4.

Figure 6:
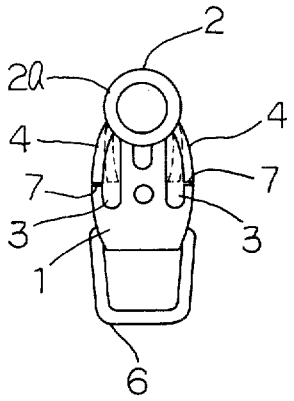
FIGS. 6 to 8 are views showing modified embodiment of the invention with runner portions omitted in FIGS. 7 and 8.
Figure 7:
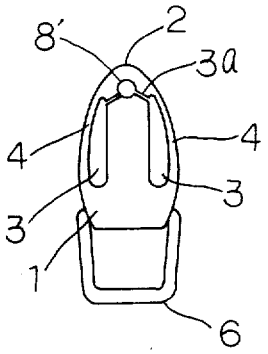
Figure 8:
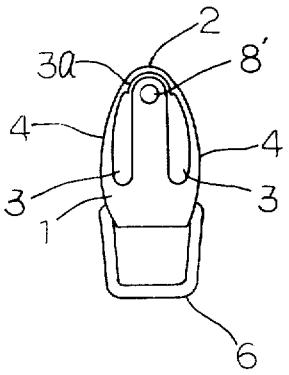

To impart improved elasticity to the outer walls 4, 4, each of the outer walls 4, 4 may be cut at a lower end portion thereof as at 7 as seen in FIG. 6. Alternatively the apertures 3, 3 may be made to communicate with each other at their upper ends through a shaft hole 8' (see FIG. 7) or directly through a slit 3*a* (see FIG. 8).

The leg 1 is provided with stoppers 5, 5 at a lower portion on its opposite side walls and with a hanger ring 6 at its lower end as provided on conventional runners. The hanger ring 6 may be made integral with or separate from the leg 1. In the latter case, the hanger ring 6 can be made of metal.

Figure 2:
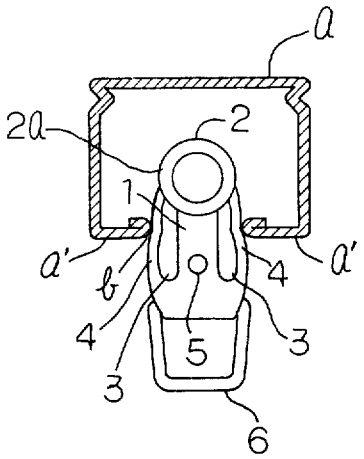
FIG. 2 is a view showing the same in its non-mounted position.

FIG. 2 shows the runner of this invention in its non-mounted position, in which the runner is freely insertable into or withdrawable from the groove b. When the width $h_2$ of the runner leg 1 is larger than the width of the groove b, the outer walls 4, 4 of the leg 1 are deformed by being forced inward against the springlike elasticity thereof.

FIG. 3 shows the runner in its mounted position. The runner in the position shown in FIG. 2 is brought to this position when turned through 90 degrees about its vertical axis with the leg outer walls 4, 4 inwardly pressed and deformed against the elasticity thereof. The runner in the position of FIG. 3, when turned through 90 degrees, is brought to the position of FIG. 2 and can be easily withdrawn from the groove b.

When the runner is brought to the proper state shown in FIG. 3, the outer walls 4, 4 are restored to their original state by the inherent elasticity, and the leg 1 is retained in the groove b against rotation, permitting the runner to remain in its proper mounted position reliably with stability.

According to this invention, the runner can be fitted into or removed from a desired portion of the groove of the curtain rod from therebelow. A desired number of runners are therefore installable in place or removable therefrom by an extremely simple procedure.

What is claimed is:

1. A curtain runner for use with a tubular curtain rod having a pair of guide rails opposed to each other at its bottom and a groove defined by the guide rails, the runner being T-shaped in a front view and including a head having runner portions on its opposite sides and a leg extending downward from the head, the runner being travellable along the groove with the runner portions supported on the guide rails of the curtain rod and with the leg inserted in the groove against rotation, said leg comprising synthetic resin and having a pair of vertically elongated apertures extending therethrough in parallel to the axis of the runner portion and communicating with each other at their upper ends through a slit to impart springlike elasticity to the front and rear outer walls of the leg, the runner being shiftable from its proper mounted position to a non-mounted position or from the non-mounted position to the proper mounted position by turning the leg in the groove through about 90 degrees while pressing and deforming the outer walls inward against the springlike elasticity thereof, the runner head having a width in the direction of travel of the runner approximately equal to or smaller than the width of the groove so that the runner in the non-mounted position is insertable into or withdrawable from the groove, the leg having a width in the direction of travel of the runner to render the leg insertable into or withdrawable from the groove with or without inwardly pressing the outer walls against the elasticity thereof.

2. A curtain runner as defined in claim 1 wherein each of the apertures has an outer wall and wherein each outer wall has a slit at a lower portion cut out from the main body of the leg.

3. A curtain runner as defined in claim 1 wherein said runner portion includes a shaft hole and wherein said slit communicates with said shaft hole.

4. A curtain runner as defined in claim 1 wherein the width of the leg in the direction of travel of the runner is larger than the width of the groove.

* * * * *